United States Patent [19]

Nilsen et al.

[11] Patent Number: 4,759,295

[45] Date of Patent: Jul. 26, 1988

[54] FREIGHT PALLET

[76] Inventors: Morten N. Nilsen, Fuglemosevej 5, DK-2970 Hørsholm, Denmark; Tor N. Nilsen, Ostrevei 25, N-3150 Tolvsrød, Norway

[21] Appl. No.: 736,964

[22] Filed: May 21, 1985

Related U.S. Application Data

[63] Continuation-in-part of Ser. No. 491,330, Apr. 19, 1983, abandoned.

[30] Foreign Application Priority Data

Aug. 21, 1981 [NO] Norway ..... 812840

[51] Int. Cl.[4] ..... B65D 19/34

[52] U.S. Cl. ..... 108/51.3; 248/174

[58] Field of Search ..... 229/DIG. 4; 493/356, 493/373, 421; 108/51.3, 56.1, 51; 248/459, 174; 206/599, 600, 386

[56] References Cited

U.S. PATENT DOCUMENTS

| | | | |
|---|---|---|---|
| 2,444,183 | 6/1948 | Cahners | 108/51.3 |
| 2,770,406 | 11/1956 | Lane | 229/DIG. 4 X |
| 3,221,973 | 12/1965 | Kalbrener | 206/600 |
| 3,626,860 | 12/1971 | Blatt | 108/51.3 |
| 3,649,398 | 3/1972 | Keith | 229/DIG. 4 X |
| 3,881,794 | 5/1975 | Henning | 312/259 |
| 3,952,672 | 4/1976 | Gordon et al. | 108/51.3 |

FOREIGN PATENT DOCUMENTS 144665 7/1981 Norway .

*Primary Examiner*—Kenneth J. Dorner
*Assistant Examiner*—Peter R. Brown
*Attorney, Agent, or Firm*—Ladas & Parry

[57] ABSTRACT

A disposable freight pallet.

The freight pallet is made of sheet-formed material and has a support plate (14) with parallel ribs (13,16) depending from the underside thereof. The plate material (2) for the pallet blank (1) is reinforced with foil material on at least one side thereof. The ribs are produced by forming a plurality of parallel, V-shaped grooves (5,6,7,8) in two opposing end sections of the plate, the bottom of the grooves extending almost to the inside face of the reinforcing foil (3), and bending the strip portions (9,10,11,12) of plate material formed between said grooves back from the plane of the plate. At least four grooves (5,6,7,8) are formed in the same surface of the plate (2). All the strip portions (9,10, 11,12) are folded back in the same direction, and the fourth strip (12), counting outwardly from the center of the plate, is thereby disposed with its upper surface in contact with the underside of the support plate (14) and is secured thereto, preferably by gluing (15).

2 Claims, 2 Drawing Sheets

FREIGHT PALLET

Figure 1:
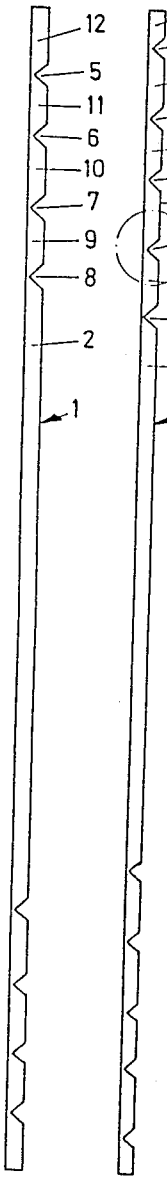

This is a continuation-in-part of co-pending application Ser. No. 491,330 filed on Apr. 19, 1983 now abandoned.

The present invention relates to a freight pallet comprising a support plate with mutually parallel legs depending from the underside thereof, wherein the legs are integral with the support plate which is made of a sheet-formed material, preferably a porous wood fibre plate that is reinforced with an adhered foil of a high tensile stength, easily flexible material, the legs being produced by forming a plurality of parallel, V-shaped grooves in two opposing end sections of the plate, the bottom of the grooves extending almost to the foil on the opposite surface of the plate, and bending the strips of plate material formed between the grooves back from the plane of the plate to form the legs.

Such a freight pallet is disclosed in Norwegian Pat. No. 144,665. Freight pallets of this type are primarily intended to be used as disposable pallets for consumer goods, used once and then discarded. Such pallets are finding ever wider application, as many consumer items are now being packed on disposable pallets and shipped thereon until they reach the retailer. In the case of household items, the merchandise may even remain on the pallet for display in the store, the customer serving himself directly from the pallet.

It is a prerequisite that pallets of this type must be produced at the lowest possible cost, because only if the pallet constitutes a very small part of the price of the merchandise is the use of disposable pallets for transporting goods practicable.

The pallet shown and described in Norwegian Pat. No. 144,665 is primarily intended for carrying lightweight goods, and is not suitable for the transportation of heavier merchandise such as refrigerators, deep freezers, washing machines, stoves and the like, since the ribs have comparatively little ability to withstand forces directed toward their lateral edges.

It is the object of the invention to provide a freight pallet of the above type in which the legs are capable of withstanding relatively large laterally-directed forces. Thus, the pallet of the invention can be utilized for shipping heavy items such as refrigerators, deep freezers, washing machines, stoves and the like, as well as larger quantities of heavier commodities such as sugar.

This object is obtained in accordance with the invention with a freight pallet of the above-defined type, which is characterized in that at least four grooves are formed in the same surface of the plate at two opposing end sections thereof, that all of the plate strips between the grooves are folded back in the same direction, and that the fourth such strip, counting outwardly from the center of the plate, is disposed with its upper surface in contact against the underside of the support plate and adhered thereto, preferably by gluing.

In a preferred embodiment, the innermost groove has an angle of greater than 90°, the next two less than 90° and the fourth greater than 90°, so that when the innermost plate strip which forms the outside wall of the leg is bent back, it will incline inwardly toward the middle of the pallet, while the next plate strip which forms the bottom wall of the leg will extend parallel to the support plate, the third strip forming the inside wall of the leg will incline in an opposite direction from the first strip, and the fourth strip will extend parallel to the support plate, in contact against the underside thereof.

An embodiment having even greater supporting strength is characterized in that five grooves are provided in the plate, thus forming five parallel folding strips, and that the outer strip is arranged in contact against the inside surface of the first strip.

The two legs of the pallet, disposed at two opposing edges of the plate, will have a trapezoidal shape, the two side walls of the leg converging toward each other from the underside of the plate. The fourth folding strip is glued to the underside of the support plate, and the optional fifth strip is glued to the inside surface of the outside wall of the leg. Owing to the trapezoidal shape and the solid bonding, the legs obtain very high strength. The V-shaped grooves are produced in the plate member by the manufacturer and the plate is shipped in a flat state, in stacks, to the user of the pallet. Thus, the pallet is convenient and economical to transport. The pallet legs can then be bent into position by the user with simple hand grips, and the legs adhered to the underside of the plate using quick-drying glue or optionally double-stick tape. It is neither necessary nor desirable to apply glue in the V-shaped grooves.

In accordance with a further feature of the invention, the folding strips are bent a greater number of degrees in relation to the adjacent strip than the number of degrees of the V-groove between the same members, so that the foil becomes tensioned. In this way, one obtains a very stable leg which will not become loose and unsteady if subjected to continual vibration and/or pressure. The plate material utilized may be, e.g., 10–12 mm thick, porous wood fibre plate, and this material in combination with the ribs formed in accordance with the invention provides a stable pallet which also has shock-absorbing properties so that the transported merchandise will not become damaged during shipment. A modification of the invention, wherein the plate-formed material is provided with reinforcing foil on both surfaces thereof and the pallet is provided with a third rib in the center, is characterized in that the third leg is formed by parallel plate strips formed between four V-grooves, that the grooves lying nearest the line of symmetry of the pallet are formed in the top side of the plate while the outer two grooves are formed in the bottom side, and that all of the grooves have an angle larger than 90°, so that the two side walls of the leg diverge from the bottom of the plate toward the base member of the leg, which extends parallel to the support plate. Such a pallet would find application in cases in which the bottom of the merchandise or package does not provide sufficient support for its weight, and the weight is so great that the pallet's support plate is not strong enough to bear it.

There is another reason why it is important to locate the reinforcement foil at one and of the plate. In accordance with the above mentioned features of the invention when the following strips are bent at a greater number of degrees in relation to the adjacent strip than the number of degrees of V-shaped groove between those members, substantial changes occur in the structure of the plate material. This is because during the bending of the strip the plate material adjacent to the groove in general and the reinforcement foil in particular will be compacted along the inner part of the angle faces.

Figure 3:
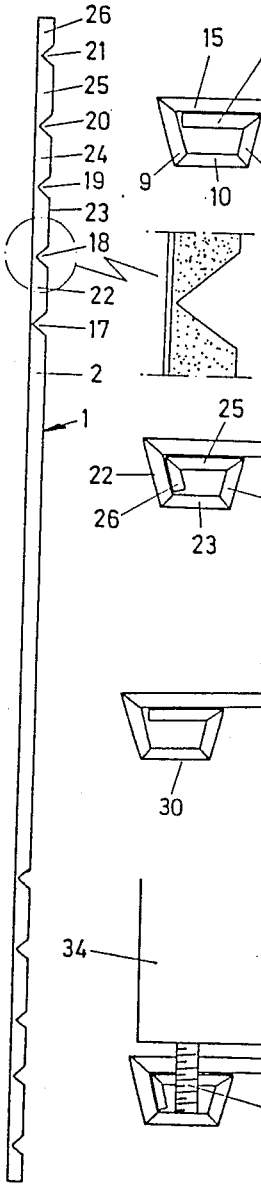
Figure 2:
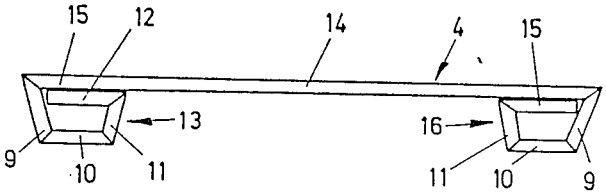
Figure 4:
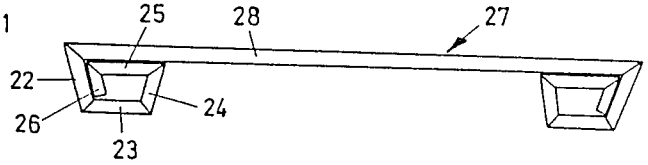
Figure 5:
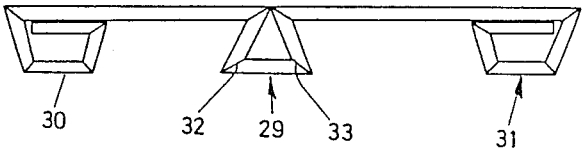
Figure 6:
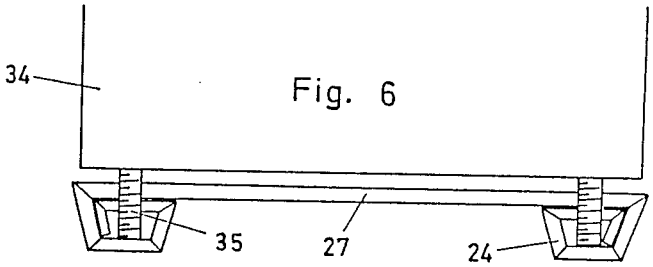
Figure 7A:
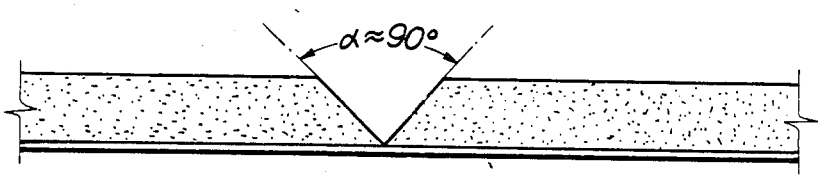
Figure 7B:
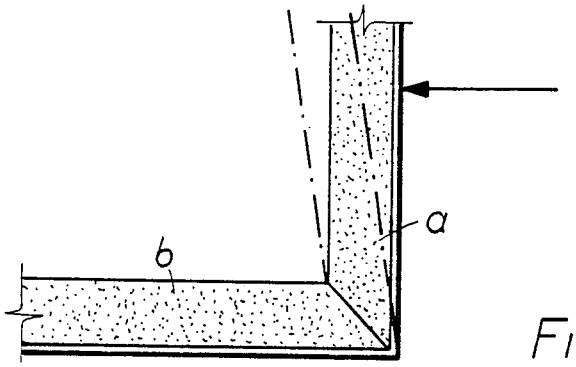
Figure 8A:
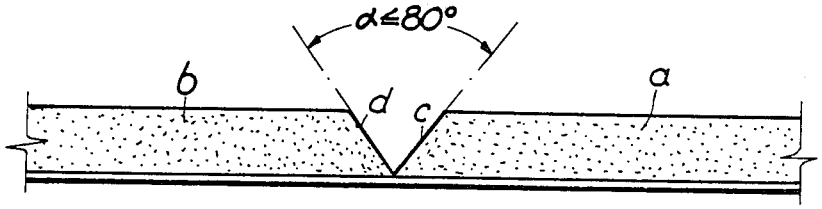
Figure 8B:
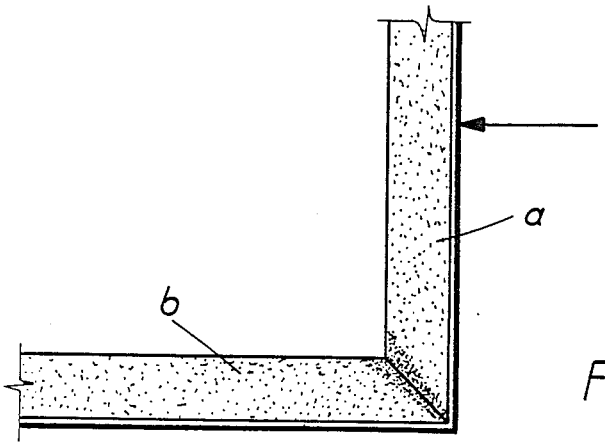

The invention will be explained in greater detail in the following with reference to the accompanying drawings, wherein:

FIG. 1 shows a plate member provided with four V-shaped grooves at two opposing ends thereof, FIG. 2 shows a pallet produced from the plate of FIG. 1, FIG. 3 shows a plate with five V-shaped grooves provided at two opposing end sections thereof, FIG. 4 shows a pallet produced from the plate of FIG. 3, FIG. 5 shows a modified embodiment having three legs, FIG. 6 shows a pallet in use for transporting a refrigerator, FIG. 7*a* shows a portion of a plate member having a V-shaped groove cutted at an angle substantially equal 90°;

FIG. 7*b* shows the plate member of FIG. 7*a* in a bended condition,

FIG. 8*a* shows a portion of a plate member having a V-shaped groove cutted at an angle which is less than an angle of bending of the member ($\alpha \leqq 80°$), and FIG. 8*b* shows the plate member of FIG. 8*a* in a bended condition having a compacted area.

The pallet blank 1 shown in FIGS. 1 and 3 consists of a porous huntonite plate 2, reinforced on one or both sides thereof with a high tensile strength foil 3, e.g., reinforced paper. The foil 3 is adhered to the plate 2 by gluing. The pallet blank shown in FIG. 1, which is formed into the pallet 4 in FIG. 2, is provided with four V-shaped grooves 5,6,7, and 8 at two opposing end sections thereof. The grooves can be produced by milling or cutting. The groove 8 and the groove 5 have an angle somewhat larger than 90°, for example 100°, whereas the grooves 6 and 7 have an angle less than 90°, for example 85°. As may be seen in the detail shown in connection with FIG. 3, the groove is milled or cut almost down to the reinforcing foil 3 on the other side of the plate.

The pallet blank 1 is produced with grooves at the factory and is shipped in a flat state to the user of disposable pallets. When the pallet is to be used, the two end sections of the plate are folded inwardly toward the middle of the plate, so that the folding strip 9, formed as an elongated strip of plate material between the grooves 8 and 7, forms the outside wall of the pallet rib 13. Because the angle of the groove 8 exceeds 90°, the side strip 9 will form an acute angle relative to the pallet support plate 14, thus sloping inwardly toward the center of the pallet. The strip 10 forms an obtuse angle relative to the strip 9 because the angle of the groove 7 is less than 90°, and the bottom wall formed by the strip 10 will extend parallel to the support plate 14. The strip 11, which forms the inside wall of the leg will also form an obtuse angle in relation to the strip 10 because the angle of the groove 6 is less than 90°. The strip 12 forms an acute angle in relation to the inside wall strip 11 and will extend parallel to and in contact with the underside of the support plate 14. Thus, the leg has a substantially trapezoidal cross section. The upper side of the strip 12 is joined to the underside of the support plate 14 by means of a plain glue joint 15. The rib 16 on the opposite side of the pallet is formed in the same manner as the leg 13.

The pallet blank 1 in FIG. 3 is produced in the same way as the plate of FIG. 1, except that five V-shaped grooves are formed at two opposing ends of the plate. The grooves 17, 20 and 21 have an angle greater than 90°, while the grooves 18 and 19 have an angle of less than 90°. The plate strips 22, 23, 24 and 25 are bent in the same way as explained in connection with FIG. 2 to produce the reinforced pallet 27 of FIG. 4. The end strip 26 is bent back such that it extends parallel to the inside surface of the outside wall strip 22 and is glued thereto. Thus, glue joints are provided between the underside of the support plate 28 and the strip 25 and between the inside surface of the strip 22 and the outside surface of the strip 26. With this embodiment, a very strong and stable rib is obtained.

FIG. 6 shows an example of the pallet being utilized for transporting a refrigerator. On the bottom of the refrigerator 34 are four adjustment screws 35, which are screwed down into the ribs 24 of the pallet. Bores for the screws may be formed in advance in the pallet blank.

An important feature of the present invention is that the plate is provided with V-shaped grooves having an angle between the two cut faces of the groove being less than the angle between the two adjacent plate strips when they are bent to the predetermined angle during manufacturing of a pallet.

The purpose of this feature is to strengthen the plate material in the angle area of the pallet. The pallet according to the invention is made of soft wood fibre plate which is reinforced with a foil of high tensile strength on the side opposite the grooves.

FIGS. 7*a* and 7*b* show a plate member having a V-shaped groove cut at an angle substantially equal to an angle of bending a plate. In some instances this angle could be 90°. If one portion of a plate is subjected to a vertical force it will be easily bent over as it shown in FIG. 7*b*.

However, if the angle $\alpha$ of the V-shaped groove shown on FIG. 8*a* is less than the angle of bending of two plate strips, the plate material adjacent to the groove will be compacted along the inner parts of the angle faces c and d. In some instances the angle $\alpha$ could be $\leqq 80°$. Therefore, the plate material subjected to the bending will be compacted and the reinforcing foil will be stressed. In view of the changes in the structure of the material of the plate the pallet will be able to withstand greater side forces.

We claim:

1. A freight pallet comprising a support plate of sheet-formed soft material, preferably a porous wood fibre plate reinforced with an adhered foil of a high tensile strength easily flexible material, said plate having substantially parallel first and second legs formed on the underside thereof and being integral with the support plate, said legs being produced by forming a plurality of parallel, V-shaped grooves in one side of said plate and at opposite end sections thereof with the bottoms of the grooves being adjacent the foil on the opposite side of the plate, and bending all strip portions of plate material formed between said grooves back from the plane of the plate, at least four grooves being formed in each end section on said one side of the plate and all said strip portions between the grooves being bent back in the same direction so that the fourth strip counting outwardly from the center of the plate is thereby disposed with its upper surface in contact against the underside of the support plate and is secured thereto, and the plate strip portions between the grooves are bent a greater number of degrees in relation to the adjacent strip than the number of degrees of the angular groove between the same two strip portions so that the plate material is compacted and the foil is tensioned, the sheet-formed material is provided with reinforcing foil on both sides thereof, and the pallet is provided with third leg in the center of the pallet, said third leg being formed by substantially parallel strip portions of the plate, formed between four V-shaped grooves arranged symmetrically around a central axis which extends parallel to said first and second legs, the two grooves which are nearest the central axis of the pallet being formed in the top side of the plate while the two outer grooves are formed in the underside of the plate, all said grooves having an angle greater than 90°, so that the two side walls of the third leg diverge outwardly from the underside of the plate toward a supporting base member of the leg, which extends substantially parallel to the pallet support plate, and the upper surfaces of the pallet support plate are adjacent to each other at an apex of the side walls of the third leg.

2. A freight pallet according to claim 1 wherein five grooves are formed in each opposite end section of the plate to define five parallel strip portions, and wherein, when bent into position, the outermost strip is disposed in contact against the inside surface of the first strip portion.

* * * * *

UNITED STATES PATENT AND TRADEMARK OFFICE

CERTIFICATE OF CORRECTION

PATENT NO. : 4,759,295

DATED : July 26, 1988

INVENTOR(S) : Morten NILSEN et al

It is certified that error appears in the above-identified patent and that said Letters Patent is hereby corrected as shown below:

On title page 1, left column, item [63], after "abandoned" insert -- and PCT/NO82/00044 filed August 18, 1982 --.

Signed and Sealed this

Thirty-first Day of January, 1989

*Attest:*

DONALD J. QUIGG

*Attesting Officer*

*Commissioner of Patents and Trademarks*